United States Patent [19]

Putney et al.

[11] 4,013,807

[45] Mar. 22, 1977

[54] COATING ELECTRONIC COMPONENTS BY MEANS OF FLUIDIZED BED

[75] Inventors: Gordon A. Putney, New Berlin; William D. McCoy, Brookfield, both of Wis.

[73] Assignee: Systemation Div. of Koerper Engineering Associates, Inc, Milwaukee, Wis.

[22] Filed: Mar. 26, 1975

[21] Appl. No.: 562,186

[52] U.S. Cl. ..... 427/184; 118/308; 118/309; 118/416; 118/428; 118/DIG. 5; 427/185; 427/195

[51] Int. Cl.[2] ..... B05D 1/24

[58] Field of Search ..... 427/185, 184, 195; 118/308, 309, 428, DIG. 5, 416

[56] References Cited

UNITED STATES PATENTS

| | | | |
|---|---|---|---|
| 3,167,454 | 1/1965 | Tompson | 118/DIG. 5 |
| 3,197,328 | 7/1965 | Jung et al. | 118/DIG. 5 |
| 3,261,707 | 7/1966 | Korski et al. | 118/406 X |
| 3,431,887 | 3/1969 | Pettigrew et al. | 118/406 X |
| 3,834,927 | 9/1974 | Putney | 118/DIG. 5 X |
| 3,875,898 | 4/1975 | Braden | 427/185 |
| 3,884,182 | 5/1975 | Jones | 118/DIG. 5 X |

*Primary Examiner*—Ronald H. Smith
*Assistant Examiner*—Shrive P. Beck
*Attorney, Agent, or Firm*—Ira Milton Jones & Associates

[57] ABSTRACT

A workpiece such as an electronic component, comprising a body and leads that project in one direction from the body, has its body coated by immersing it in a fluidized bed while the workpiece is vibrated. Immersion depth is such that the uppermost surface of the body is at or just slightly below the top surface of the fluidized bed. Vibration of the workpiece during immersion ensures a uniform thickness coating all over the body and prevents "pants legs" on the leads.

3 Claims, 6 Drawing Figures

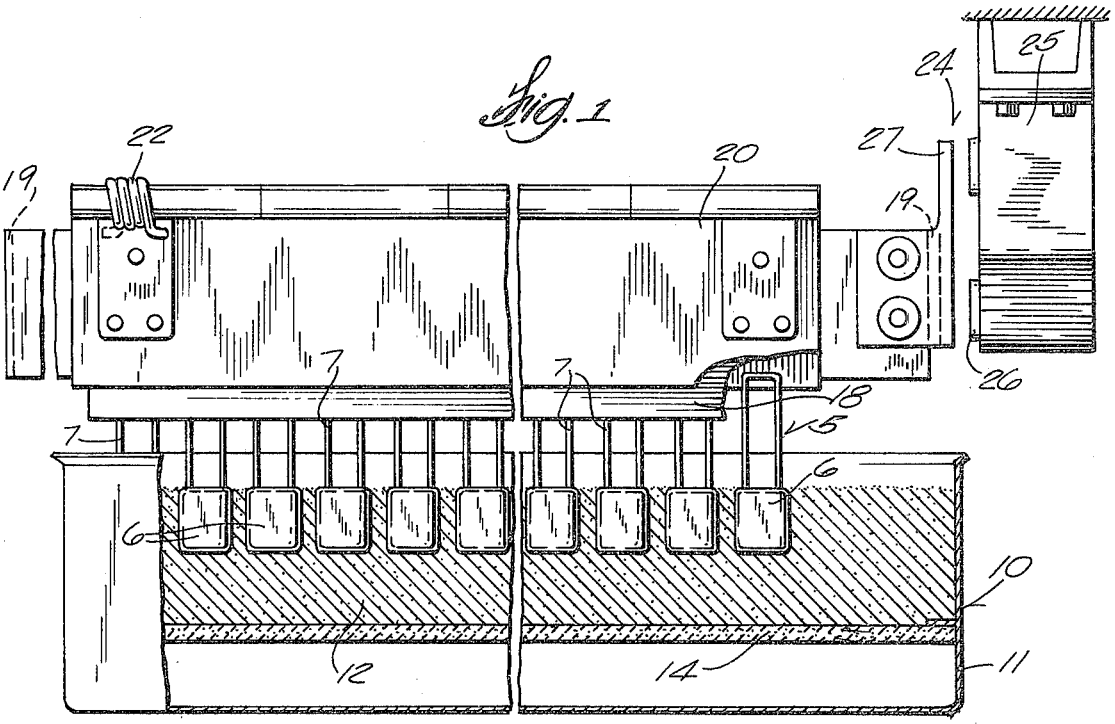
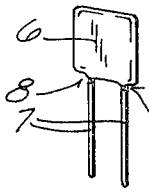
Fig. 6
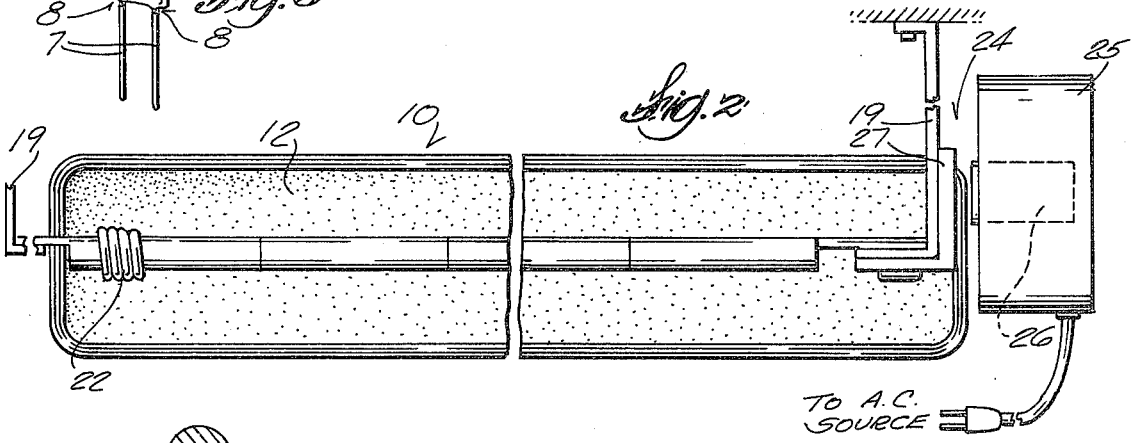
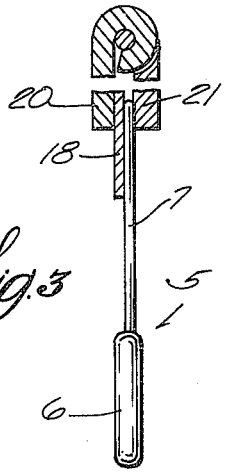
Fig. 3
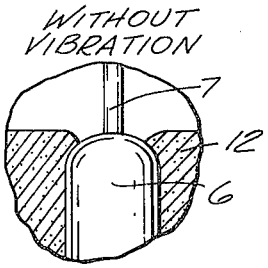
Fig. 5
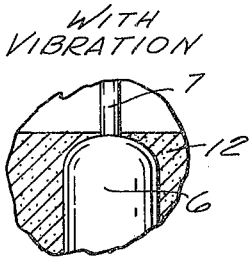
Fig. 4

COATING ELECTRONIC COMPONENTS BY MEANS OF FLUIDIZED BED

This invention relates to the coating of electronic components and similar workpieces with heat fusible insulation material; and the invention is more particularly concerned with so applying such coatings by means of a fluidized bed that the body of the workpiece obtains a coating that is of substantially uniform thickness over the entire surface thereof, while leads that project in one direction from the body are coated only on their portions that are closely adjacent to the body.

Typical workpieces to which the present invention is applicable include wrapped foil capacitors, epoxy coated resistors, and hybrid circuits. In each case the workpiece comprises a body that may be cylindrical, block-like, disk-like or of some other more or less regular shape, with two or more leads projecting in one direction from the body and serving for its connection with other components in an electrical or electronic circuit.

The present invention relates to the coating of the bodies of such workpieces by dipping them, while heated, into a so-called fluidized bed. A fluidized bed suitable for the purpose can comprise an elongated trough-like vessel that holds a supply of heat fusible material in finely divided solid form. The vessel has what is in effect a false bottom, in the nature of a plate of porous medium, and a gas (usually air) is forced upwardly through that plate to suspend and agitate the particles of material.

In its earlier stages of development the fluidized bed technique was not suitable for the coating of many types of workpieces because gas would channel up through parts of the bed and cause geysering and boiling that denoted substantial non-uniformity of particle density within the bed. This problem was overcome with the invention covered by U.S. Pat. No. 3,834,927, to G. A. Putney, which discloses that geysering and boiling can be prevented if the vessel that contains the bed is vibrated, and if the fluidizing gas is introduced into the bottom of the bed through an admission zone which is substantially narrower than the upper free surface of the bed, to induce a more or less rotary gas flow in a direction or directions transverse to the length of the bed. With geysering and boiling thus eliminated, a fluidized bed has many of the characteristics of a quiescent liquid; hence a body dipped into it tends to acquire a more or less even coating of heat fusible material. If the workpiece is properly heated before being dipped into the fluidized bed, so that its temperature is above that at which the material fuses, it can be withdrawn from the bed with a coating having the smoothness and uniformity that might be obtained by dipping it into a liquid varnish or lacquer, although the coating obtained with the fluidized bed technique also possesses other and desirable characteristics not obtainable with liquid dip coatings.

However, even when the teachings of the Putney patent were followed, the results obtained in the coating of electronic components of the above described character often left much to be desired when the bodies of such components had relatively broad surfaces that were uppermost in the fluidized bed. With electronic components it is important that the leads be kept free of coating material except for those portions of them that are directly adjacent to the body, for otherwise it is not possible to install the component on a printed circuit board, with its body in close proximity to the board, without first removing some of the insulation material from the leads. Long "pants legs" of insulation coating on the leads also create the risk that any bending of the leads close to the body that occurs after the coating is cured may induce a cracking or deformation of the "pants legs" that spreads into the body coating.

Heretofore, the formation of objectionable "pants legs" on parts with substantially wide bodies could be prevented only at the expense of having an incomplete coating on the uppermost surface of the body, owing to the fact that the workpiece had not been immersed deeply enough into the fluidized bed. Furthermore, when immersion of such a part was deep enough to assure coating of the entire body — and also, inevitably, the formation of objectionable "pants legs" — the coating on the uppermost surface of the body was of markedly irregular thickness.

The general object of the present invention is to avoid this dilemma and to enable a fluidized bed to be so employed for the coating of electronic components and similar workpieces that a substantially uniform thickness coating is applied over the entire body and upon only those portions of the leads that are closely adjacent to the body, with just enough of the leads coated to insure complete encapsulation of the body but with the leads free from objectionable "pants legs" as well as from spatters of coating.

The invention rests upon an appreciation of the fact that when a body is immersed in a fluidized bed, with the top surface of the body substantially at the level of the top surface of the fluidized bed, the body tends to form a shallow well or depression in the fluidized bed, due to its interference with the gas flow that moves and suspends the particles of heat fusible material. If the body is immersed to a greater depth, so that the particles can reach its top surface, then the leads are also immersed to a substantial depth such that they acquire objectionably long "pants legs," and, in addition, high concentrations of particles tend to settle on the top surface of the body, close to its side surfaces, building up into relatively heavy ridges which tend to block movement of particles inwardly across them so that a zone of the top surface that lies between those ridges receives a relatively thin coating.

With these considerations in mind, it is another object of this invention to provide a method and apparatus for coating workpieces with the use of a fluidized bed, whereby the formation of wells or depressions in the top surface of the bed is prevented so that a workpiece can be immersed in the bed to such depth that the top surface of its body is at or very slightly below the level of the top surface of the bed and assurance is had that the body will acquire a coating that is of uniform thickness over its entire surface.

It is also an object of this invention to provide a method and apparatus of the character described that lends itself well to mass production operations in that it allows a large number of workpieces to be coated simultaneously.

With these observations and objectives in mind, the manner in which the invention achieves its purpose will be appreciated from the following description and the accompanying drawings, which exemplify the invention, it being understood that changes may be made in the precise method of practicing the invention and in the specific apparatus disclosed herein without departing from the essentials of the invention set forth in the appended claims.

The accompanying drawings illustrate one complete example of an embodiment of the invention constructed according to the best mode so far devised for the practical application of the principles thereof, and in which:

FIG. 1 is a view in elevation, with portions cut away and shown in section, of apparatus embodying the principles of this invention, illustrating the coating of a batch of typical workpieces;

FIG. 2 is a top view of the apparatus shown in FIG. 1;

FIG. 3 is a view in transverse vertical section through the holder of the apparatus;

FIG. 4 is a detail fragmentary view of a workpiece immersed in a fluidized bed, with the workpiece subjected to vibration in accordance with the principles of this invention;

FIG. 5 is a view similar to FIG. 4 but illustrating the condition of the top surface of the fluidized bed around a workpiece that is not being vibrated; and FIG. 6 is a perspective view of a workpiece that has been coated in accordance with the principles of this invention.

Referring now to the accompanying drawings, the numeral 5 designates a typical workpiece of the type that can be coated by means of the present invention, illustrated as a capacitor for electronic circuits and comprising a more or less tablet-like body 6 and a pair of parallel leads 7 that project to one side of the body.

The invention contemplates use of the fluidized bed technique to coat the body of the workpiece with insulation material; and by reason of the application of the principles of the invention, the coating on the body will be of substantially uniform thickness over the entire surface thereof while the leads will have a coating which is continuous with the body but which, as indicated at 8, extends outwardly along them to only a very short distance from the body.

The fluidized bed 10 by which workpieces are coated as just described comprises an elongated, open-topped trough-like vessel 11 which contains heat fusible material 12 in finely divided solid form. Heat fusible materials suitable for the purpose, which may be either thermosetting or thermoplastic materials, include powdered vinyl and powdered epoxy resins, as well as others that are known to those familiar with fluidized bed technology.

As is conventional with fluidized bed arrangement, the vessel 11 has a horizontal porous plate 14 spaced a distance above its bottom wall, and there is provision for forcing air or other gas upwardly through this plate and thus through the heat fusible material to fluidize the same. It is contemplated that the principles of Putney U.S. Pat. No. 3,834,927 will be embodied in the fluidized bed employed in the practice of the present invention, and therefore provision will be made for causing a more or less rotary circulation of gas in the bed above the plate 14, which circulation is in a direction or directions transverse to the length of the vessel, and also that provision will be made for vibrating the vessel, all for the purpose of assuring that the top surface of the bed will be smooth and even and that the bed will be free from geysering and boiling. The structure by which such rotary circulation and vessel vibration are achieved is not shown in the drawings, inasmuch as reference can be made to the Putney patent for a complete disclosure thereof in various embodiments.

It might be mentioned, at this point, that the top surface of the fluidized bed will be crowned or convex across its width, but assuming that the side walls of the vessel are straight and parallel to one another, the height and curvature of the top surface of the bed will be uniform all along the length of the vessel, so that the top of the fluidized bed will lie along a perfectly straight line (to within a very small fraction of an inch) on any vertical plane parallel to the side walls.

Although the present invention lends itself to coating workpieces one at a time, it will usually be preferable to coat as many of them simultaneously as can be accommodated in the uniform density portion of the fluidized bed, which comprises all but small portions thereof at its ends. The workpieces can be held in a holder or clamp 16 that can be very similar to a piano hinge, having a pair of long, narrow jaw members that are connected at their upper longitudinal edges to swing relative to one another. Preferably each batch of workpieces is secured to a carrier strip 18 of cardboard or the like, by which the workpieces can be handled as a group before they are received in the holder 16 and after they are withdrawn from it. In any case, the workpieces are secured in the holder with their leads coplanar and all extending in the same direction, and with their bodies in a straight row and spaced from one another at intervals large enough to assure that their adjacent ends will be properly coated. During dipping the holder is so oriented relative to the fluidized bed vessel that the leads of the several workpieces lie in a vertical plane that is parallel to the side walls of the vessel and about midway between them.

The holder is supported over the fluidized bed on a pair of laterally extending spring arms 19, one at each end thereof. As shown, the holder comprises front and rear jaw members, designated by 20 and 21 respectively. The rear jaw member is somewhat longer than the front one, projecting beyond the front one at both ends thereof. The spring arms 19 are secured to the end portions of the rear jaw member and project rearwardly therefrom. At their rear ends the spring arms are connected with a suitable mechanism (not shown) by which the holder can be raised and lowered either manually or automatically. As shown, the front jaw member is biased to a closed or clamping position by means of one or more torsion springs 22, and is provided with suitable means (not shown) by which it can be swung open for loading and unloading of the holder.

The spring arms 19 provide for lengthwise vibratory movement of the gripper by which vibration is imparted to the workpieces while they are immersed in the fluidized bed. When the workpieces are thus vibrated, they can be immersed in the fluidized bed to a level at which the top surfaces of their bodes are at, or just slightly below, the top surface of the fluidized bed, and the bodies of the workpieces will obtain a uniform thickness coating over all of their surface portions including their top surfaces, while the leads will be coated only closely adjacent to the bodies, sufficiently to assure a good seal of the body coating but not so far out as to interfere with close mounting of the workpiece on a printed circuit board.

Vibration can be imparted to the holder by means of a vibratory motor 24. Although other types of motors can be used for the purpose, the one here illustrated is preferred because it is simple, inexpensive and does not interfere with or complicate movement of the holder to and from its dipping position. It comprises a simple electromagnet 25 that has a horseshoe core 26 and is adapted to be connected with an alternating current source. The electromagnet is stationarily mounted adjacent to one end of the holder, and the poles of its horseshoe core face lengthwise of the holder. The electromagnet cooperates with a rigid armature 27, which can comprise a bracket-like piece of ferromagnetic material fixed on the end portion of the rear jaw member in slightly spaced opposing relation to the magnet holes. The armature of course responds to the alternating magnetic field of the electromagnet to impart lengthwise vibratory movement to the holder.

The vibration should obviously continue all during the time that the bodies of the workpieces are fully immersed in the fluidized bed, and preferably begins just before they enter the fluidized bed and terminates only when they are fully withdrawn. With the particular vibratory motor described above, and with the armature of that motor properly shaped, the electromagnet can be kept energized continuously and vibration of the holder will then automatically have the preferred synchronization with immersion as the armature moves into and out of the alternating field produced by the electromagnet. The vibration that continues after withdrawal of the workpieces from the fluidized bed tends to dislodge from them any unfused powder particles, ensuring that the coating will be smooth.

The frequency of vibration does not appear to be critical. The use of ordinary 60 cycle current for energization of the electromagnet has been found to produce very satisfactory results. The amplitude of vibration likewise appears not to be critical. Excellent results have been obtained with a vibration amplitude on the order of 0.015 – 0.020 inch with ordinary electronic capacitors of various sizes.

From the foregoing description taken with the accompanying drawings it will be apparent that this invention enables an electronic component such as a capacitor to be coated with a heat fusible material by the use of the fluidized bed technique and to acquire a uniform thickness coating over its entire body that extends out over only those portions of its leads that are closely adjacent to its body.

Those skilled in the art will appreciate that the invention can be embodied in forms other than as herein disclosed for purposes of illustration.

The invention is defined by the following claims.

We claim:

1. A method by which a workpiece that comprises a body and electrical leads that project to one side of the body can have applied to it a substantially uniform thickness coating of heat plasticizable material, which coating covers all portions of the body but covers substantially only so much of each lead as to provide a seal around it at its junction with the body, and wherein the coating is applied by heating the workpiece and supporting it by its leads, body lowermost, in a fluidized bed that comprises heat plasticizable material in finely divided solid form suspended in a vessel by gas blown upwardly through the material from the bottom of the vessel, which method is characterized by:

A. so supporting the body in the fluidized bed that the top of the body is substantially at the level of the surface of the material in the fluidized bed; and B. while the workpiece is so supported, vibrating it in directions substantially parallel to the surface of the fluidized bed.

2. In the method of using a fluidized bed of heat fusible plastic material in finely divided solid form to coat a workpiece that comprises a body having leads extending to one side thereof, wherein the heat fusible material is contained in a vessel, gas is forced upwardly through the material to provide the fluidized bed, and the heated workpiece is supported with its body lowermost and in the fluidized bed at a level to be wholly below the surface thereof but with its leads substantially entirely out of the fluidized bed, the characterizing step by which a substantially uniform thickness coating of the material is obtained all over the body while the leads remain uncoated except to the extent of providing a seal around each of them at its junction with the body, which step comprises:

vibrating the workpiece in substantially horizontal directions while the body is immersed in the fluidized bed.

3. The method of claim 2, further characterized by:

continuing to so vibrate the workpiece as it is being withdrawn from the fluidized bed and until it is entirely out of the same.

* * * * *